US011453927B2

(12) United States Patent
Honda et al.

(10) Patent No.: US 11,453,927 B2
(45) **Date of Patent: *Sep. 27, 2022**

(54) COLD ROLLED STEEL SHEET AND METHOD OF MANUFACTURING THE SAME

(71) Applicant: JFE Steel Corporation, Tokyo (JP)

(72) Inventors: Yuma Honda, Tokyo (JP); Yoshihiko Ono, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 357 days.

This patent is subject to a terminal disclaimer.

(21) Appl. No.: 16/485,511

(22) PCT Filed: Feb. 5, 2018

(86) PCT No.: PCT/JP2018/003761

§ 371 (c)(1),
(2) Date: Aug. 13, 2019

(87) PCT Pub. No.: WO2018/147211

PCT Pub. Date: Aug. 16, 2018

(65) Prior Publication Data

US 2020/0017933 A1 Jan. 16, 2020

(30) Foreign Application Priority Data

Feb. 13, 2017 (JP) ..... JP2017-024154

(51) Int. Cl.

| | |
|---|---|
| ***C21D 9/46*** | (2006.01) |
| ***C21D 8/02*** | (2006.01) |
| ***C23C 2/06*** | (2006.01) |
| ***C22C 38/00*** | (2006.01) |

(52) U.S. Cl.

CPC ..... *C21D 9/46* (2013.01); *C21D 8/0226* (2013.01); *C21D 8/0236* (2013.01); *C22C 38/002* (2013.01); *C23C 2/06* (2013.01); *C21D 2211/005* (2013.01)

(58) Field of Classification Search

CPC ..... C21D 9/46; C21D 8/0226; C21D 8/0236; C21D 2211/005; C22C 38/002; C23C 2/06

See application file for complete search history.

(56) References Cited

U.S. PATENT DOCUMENTS

| | | | | |
|---|---|---|---|---|
| 2004/0261919 | A1 | 12/2004 | Nakajima et al. | |
| 2009/0139611 | A1* | 6/2009 | Kimura | C22C 38/001 148/533 |
| 2012/0037281 | A1 | 2/2012 | Ono et al. | |
| 2012/0040203 | A1 | 2/2012 | Takagi et al. | |
| 2012/0118439 | A1 | 5/2012 | Ono et al. | |
| 2013/0000796 | A1 | 1/2013 | Takeda et al. | |
| 2013/0206288 | A1 | 8/2013 | Kaneko et al. | |
| 2014/0234655 | A1* | 8/2014 | Takashima | C21D 8/0463 428/659 |
| 2016/0002756 | A1* | 1/2016 | Takeda | C22C 38/002 428/659 |

FOREIGN PATENT DOCUMENTS

| | | | | |
|---|---|---|---|---|
| CN | 102414335 | A | | 4/2012 |
| CN | 102639738 | A | | 8/2012 |
| CN | 102803543 | A | | 11/2012 |
| EP | 2 559 782 | A1 | | 2/2013 |
| EP | 3 054 025 | A1 | | 8/2016 |
| JP | 2003-213369 | A | | 7/2003 |
| JP | 2007-211334 | A | | 8/2007 |
| JP | 2008-174776 | A | | 7/2008 |
| JP | 2009-185355 | A | | 8/2009 |
| JP | 2009-235441 | A | | 10/2009 |
| JP | 2010013700 | A | * | 1/2010 |
| JP | 2010-77511 | A | | 4/2010 |
| JP | 2010-196159 | A | | 9/2010 |
| JP | 2011-225915 | A | | 11/2011 |
| JP | 2012-001773 | A | | 1/2012 |
| JP | 2013-076114 | A | | 4/2013 |
| JP | 2014-025133 | A | | 2/2014 |
| JP | 2014025133 | A | * | 2/2014 |
| KR | 10-2012-0068990 | A | | 6/2012 |
| WO | 2004/001084 | A1 | | 12/2003 |

OTHER PUBLICATIONS

Shastry, Corrosion of Metallic Coated Steels, 2005, ASM International, vol. 13B, p. 35-39 (Year: 2005).*

The First Office Action dated Sep. 24, 2020, of counterpart Chinese Application No. 201880010866.7, along with a Search Report in English.

The Extended European Search Report dated Dec. 2, 2019, of counterpart European Application No. 18750868.4.

Office Action dated Sep. 17, 2020, of counterpart Korean Application No. 2019-7023380, along with a Concise Statement of Relevance of Office Action in English.

* cited by examiner

*Primary Examiner* — Anthony M Liang
(74) *Attorney, Agent, or Firm* — DLA Piper LLP (US)

(57) ABSTRACT

A cold rolled steel sheet having a high strength, an aging resistance, a high yield ratio and a small anisotropy of tensile strength is obtained by hot rolling and cold rolling a steel material containing in percent by mass C: 0.06-0.14%, Si: less than 0.50%, Mn: 1.6-2.5%, Nb: not more than 0.080% (including 0%), Ti: not more than 0.080% (including 0%), provided that Nb and Ti are contained in an amount of 0.020-0.080% in total, subjecting a cold rolled steel sheet continuous annealing including steps of soaking-annealing at a temperature of 840-940° C. for a holding time of 30-120 seconds, cooling from the soaking temperature to 600° C. at a rate of not less than 5° C./s, retaining in a temperature range of 600-500° C. for 30-300 seconds and then conducting a secondary cooling to apply such a steel structure that martensite is finely dispersed into ferrite base.

9 Claims, No Drawings

COLD ROLLED STEEL SHEET AND METHOD OF MANUFACTURING THE SAME

TECHNICAL FIELD

This disclosure relates to a cold rolled steel sheet used as a raw material for high-strength members of an automotive body or the like, a method of manufacturing the same and, more particularly, to a cold rolled steel sheet having a tensile strength TS of 590-800 MPa, an excellent aging resistance and a high yield ratio and being excellent in the isotropy of tensile strength, and a method of manufacturing the same.

BACKGROUND

In recent years, there are growing demands for weight reduction of an automotive body for improvement of the fuel consumption from a viewpoint of protecting global environment, and also for an increase in the automotive body strength from a viewpoint of ensuring the passenger's safety. To this end, it is actively attempted to increase the strength and decrease the thickness of a cold rolled steel sheet used as a raw material for framework members, collision-resistant members and so on of the automotive body. The cold rolled steel sheet used in the above applications is demanded to be hardly deformed at collision, or have a high yield stress to ensure the passenger's safety, be excellent in the aging resistance to stably conduct press forming without causing wrinkle patterns, bad dimension accuracy in a press-formed product even after the lapse of long time from the manufacture of the steel sheet, and be small in the anisotropy of tensile strength to ensure the dimension accuracy in press-forming.

As a technique meeting such demands, some techniques have hitherto been proposed.

For example, JP-A-2003-213369 discloses a method in which a cold rolled steel sheet containing at least one selected from Nb, Ti and V in an amount of 0.008-0.05 mass % in total is subjected to soaking annealing in a temperature range from $(Ac_1+Ac_3)/2$ to $Ac_3$, which is relatively high in the two-phase temperature range, and cooled to lower than 400° C. at a cooling rate of 2-200° C./s to thereby obtain a high-strength steel sheet having a steel structure composed mainly of ferrite and containing martensite as a second phase and being excellent in the stretch-flanging property and collision resistance.

JP-A-2010-196159 discloses a technique in which a cold rolled steel sheet controlled to have [Mneq], P and B in proper content ranges is annealed at a temperature of higher than 740° C., but lower than 840° C. on a continuous hot-dip galvanizing line, cooled at an average cooling rate of 2-30° C./s and then subjected to hot-dip galvanizing to have a steel structure comprising ferrite and the second phase and having an area ratio of the second phase of 3-15%, a ratio of martensite and residual γ in the second phase area ratio of more than 70% and a ratio of the second phase existing in triple points of grain boundaries in the second phase area ratio of not less than 50%, whereby a high-strength hot-dip galvanized steel sheet having a low YP, a high BH and an excellent aging resistance can be obtained.

JP-A-2009-185355 discloses a technique in which a cold rolled sheet containing 0.04-0.08 mass % of at least one selected from Nb and Ti in total is heated to a temperature range from $Ac_1$ to $\{Ac_1+\frac{2}{3}(Ac_3-Ac_1)\}$, which is relatively low in the two-phase temperature range, at a heating rate of not less than 5° C./s from ($Ac_1$−100° C.) to $Ac_1$, annealed in the above temperature range for a retention time of 10-30 seconds and cooled to lower than 400° C. at an average cooling rate of 40° C./s to obtain a high-strength cold rolled steel sheet having a steel structure comprised of ferrite and pearlite and having an area ratio of unrecrystallized ferrite of 20-50% and being excellent in the workability and collision resistance.

JP-A-2009-235441 discloses a high-strength cold rolled steel sheet having a high yield ratio and an excellent stretch-flanging property containing Mn: 0.6-2.0 mass % and Ti: 0.05-0.40 mass % and has a composite steel structure comprising ferrite as a primary phase and one or more selected from martensite, bainite and pearlite as a second phase and has a steel structure that an area ratio of the second phase is 1-25% and not less than $1.0\times10^9/mm^2$ of carbide containing Ti with a particle size of not more than 5 nm (Ti-based carbide) are precipitated within zones within 100 nm from grain boundaries contacting with the second phase in the ferrite.

WO 2004/001084 discloses a technique in which a hot rolled steel sheet containing a low-temperature transformation phase at a volume ratio of not less than 60% is cold rolled to form a cold rolled sheet, which is continuously annealed in a two-phase region of α+γ so that the steel structure comprises ferrite and a low-temperature transformation phase with an area ratio of not less than 0.1% but less than 10% and an average particle size d of the ferrite phase is not more than 20 μm and an average value L of a space between the average particle size d of the ferrite phase and the adjacent low-temperature transformation phase along the grain boundaries of the ferrite phase satisfies a relation of $L<3.5d$, whereby a high-strength cold rolled steel sheet being small in in-plane anisotropy of r-value can be obtained.

In the technique of JP '369, however, rapid cooling is conducted to lower than 400° C. immediately after the soaking annealing, resulting in forming a large amount of bainite. Accordingly, the amount of martensite formed is decreased. Hence, the targeted excellent aging resistance cannot be obtained.

In the technique of JP '159, since the addition amounts of Nb and Ti are small, ferrite grains are coarsened to decrease the yield stress so that the yield ratio of the resulting steel sheet is about 0.60 at most, and a targeted high yield ratio cannot be attained.

The technique of JP '355 is directed to low-temperature annealing. The most part of ferrite in the steel structure comprises unrecrystallized ferrite so that there is a problem that anisotropy of tensile strength increases.

In the technique of JP '441, Mn content is relatively small, and the fraction of martensite occupied in the second phase of the steel structure is small so that the targeted excellent aging resistance cannot be obtained.

The technique of WO '084 is directed to low-temperature annealing. Since C and Mn content are small, the amount of martensite produced is small so that the high-strength steel sheet being excellent in the targeted aging resistance cannot be obtained.

As described above, known technique of manufacturing a cold rolled steel sheet having a high strength, an excellent aging resistance, a high yield ratio and an excellent isotropy of tensile strength have not been successful.

It could therefore be helpful to provide a cold rolled steel sheet having a high strength, an excellent aging resistance and a high yield ratio and being excellent in the isotropy of tensile strength, and an advantageous method of manufacturing the same.

SUMMARY

We found that:

(1) To provide an excellent aging resistance for a cold rolled steel sheet as a product (hereinafter referred to as "product sheet"), it is effective that the steel sheet has such a structure that martensite is uniformly and finely dispersed into a ferrite base. Moreover, to establish both of the excellent aging resistance and the high yield ratio, it is effective to add Nb and/or Ti in an amount of about 0.04 mass % in total so that the crystal grain size of ferrite is made fine.

(2) When a large amount of unrecrystallized ferrite remains in the ferrite structure of the product sheet, the anisotropy of tensile strength substantially increases. Accordingly, an annealing temperature (soaking temperature) in the continuous annealing after the cold rolling desirably increases to sufficiently promote recrystallization. However, the annealing at a high temperature causes formation of a great amount of austenite. When a cooling rate after the soaking is low, austenite is transformed to ferrite and pearlite is successively produced so that martensite cannot be obtained sufficiently by the subsequent cooling. Also, when a retention temperature after the primary cooling is not controlled, austenite is transformed into bainite to form a dispersion state that martensite is divided by bainite or the like and, therefore, martensite cannot be dispersed uniformly in the ferrite base so that the excellent aging resistance cannot be obtained.

(3) However, even when the soaking annealing is conducted at a high temperature, it is possible to disperse martensite uniformly and finely into the ferrite base by rapidly cooling the sheet to 600° C. (primary cooling) after the soaking annealing to suppress pearlite transformation during the cooling, and retaining in a temperature range of 600-500° C. for a given time to promote transformation of austenite into ferrite so that austenite is reduced and finely dispersed into the ferrite base, while promoting the concentration of alloying elements into austenite and thereafter conducting secondary cooling to cause transformation of austenite into martensite and, as a result, excellent aging resistance can be provided.

(4) The cold rolled steel sheet having a high strength, an excellent aging resistance, and a high yield ratio and being excellent in the isotropy of tensile strength can be obtained by adding proper amounts of Nb and Ti, suitably controlling a soaking annealing temperature in a continuous annealing and subsequent cooling conditions and suitably controlling a dispersion state of martensite into ferrite base in the steel structure.

We thus provide:

A cold rolled steel sheet having a chemical composition comprising C: 0.06-0.14 mass %, Si: less than 0.50 mass %, Mn: 1.6-2.5 mass %, P: not more than 0.10 mass %, S: not more than 0.020 mass %, Al: 0.01-0.10 mass %, N: not more than 0.010 mass %, Nb: not more than 0.080 mass % (including 0 mass %), Ti: not more than 0.080 mass % (including 0 mass %), provided that Nb and Ti are contained in an amount of 0.020-0.080 mass % in total, and the remainder being Fe and inevitable impurities, a steel structure that an area ratio of ferrite is not less than 85%; an area ratio of martensite is 3-15%; an area ratio of unrecrystallized ferrite is not more than 5%; an average crystal grain size d of the ferrite is 2-8 μm; and a ratio (L/d) of an average value L (μm) of intervals between martensite grains closest to each other to the average crystal grain size d of the ferrite is 0.20-0.80, and mechanical properties that a yield ratio YR in a direction perpendicular to a rolling direction is not less than 0.68 and a ratio ($TS_D/TS_C$) of tensile strength $TS_D$ in a direction of 45° with respect to the rolling direction to tensile strength $TS_C$ in a direction perpendicular to the rolling direction is not less than 0.95.

The cold rolled steel sheet is characterized by containing one or more selected from Cr: not more than 0.3 mass %, Mo: not more than 0.3 mass %, B: not more than 0.005 mass %, Cu: not more than 0.3 mass %, Ni: not more than 0.3 mass % and Sb: not more than 0.3 mass % in addition to the above chemical composition.

The cold rolled steel sheet is characterized by having a zinc-based plated layer on the surface of the steel sheet.

The zinc-based plated layer in the cold rolled steel sheet is one selected from a hot-dip galvanized layer, an alloyed hot-dip galvanized layer, and an electrogalvanized layer.

A method of manufacturing a cold rolled steel sheet comprises hot rolling and cold rolling a steel material having the aforementioned chemical composition and then subjecting the obtained cold rolled sheet to a continuous annealing comprising steps of: soaking-annealing the sheet in a temperature of 840-940° C. for a holding time of 30-120 seconds; cooling from the soaking temperature to 600° C. at a rate of not less than 5° C./s; retaining the sheet in a temperature range of 600-500° C. for 30-300 seconds; and then conducting a secondary cooling to provide such a steel structure that: an area ratio of ferrite is not less than 85%; an area ratio of martensite is 3-15%; an area ratio of unrecrystallized ferrite is not more than 5%; an average crystal grain size d of the ferrite is 2-8 μm; and a ratio (L/d) of an average value L (μm) of intervals between martensite grains closest to each other with respect to the average crystal grain size d of the ferrite is 0.20-0.80 and mechanical properties that: a yield ratio YR in a direction perpendicular to the rolling direction is not less than 0.68; a ratio ($TS_D/TS_C$) of tensile strength $TS_D$ in a direction of 45° with respect to the rolling direction to tensile strength $TS_C$ in a direction perpendicular to the rolling direction is not less than 0.95.

The method is characterized by subjecting the surface of the steel sheet to a hot-dip galvanizing after the retention in the temperature range of 600-500° C. and before the secondary cooling.

The method is characterized by subjecting the surface of the steel sheet to an alloying hot-dip galvanizing after the retention in the temperature range of 600-500° C. and before the secondary cooling.

The method is characterized by subjecting the surface of the steel sheet to an electrogalvanizing after the secondary cooling.

It is possible to stably manufacture and provide a cold rolled steel sheet having a high strength, an excellent aging resistance and a high yield ratio and being excellent in the isotropy of tensile strength by controlling the chemical composition of steel, soaking annealing conditions in the continuous annealing after the cold rolling, and the subsequent cooling conditions to proper ranges and properly adjusting the steel structure of the product sheet. Therefore, we make it possible to further reduce the weight of automotive bodies and increase the strength thereof, which largely contributes to protect global environment and improve the passenger's safety.

DETAILED DESCRIPTION

There will be first described a cold rolled steel sheet.

The cold rolled steel sheet is obtained by cold rolling a hot rolled steel sheet having a given chemical composition and subjecting the sheet to a continuous annealing at a high temperature to properly adjust a steel structure. The cold rolled steel sheet includes a cold rolled steel sheet (CR) subjected to the continuous annealing and cold rolled steel sheets having a zinc-based plated layer such as an electrogalvanized steel sheet (GE), a hot-dip galvanized steel sheet (GI), an alloyed hot-dip galvanized steel sheet (GA) and the like.

The cold rolled steel sheet is also preferably a high-strength cold rolled steel sheet having a tensile strength TS of not less than 590 MPa from a viewpoint of reducing the weight of automotive bodies and increasing the strength thereof. However, since the formability is degraded with the increase of the tensile strength, the upper limit of the tensile strength is preferably about 800 MPa.

In addition to having a high strength, the cold rolled steel sheet is necessary to have such properties that: yield elongation YPEl is not caused even after the acceleration aging is applied at 50° C. for 90 days; a yield ratio YR is not less than 0.68; and a TS ratio defined by a ratio ($TS_D/TS_C$) of tensile strength $TS_D$ in a direction of 45° with respect to the rolling direction to tensile strength $TS_C$ in a direction perpendicular to the rolling direction is not less than 0.95. That is, the cold rolled steel sheet is characterized by having the high strength, in addition to that, an excellent aging resistance and a high yield ratio and being small in anisotropy of tensile strength. Moreover, YR is more preferably not less than 0.69, and TS ratio is more preferably not less than 0.96.

The tensile strength TS and yield ratio YR are measured by taking out a JIS No. 5 test specimen in a direction (C-direction) perpendicular to the rolling direction and subjecting the test specimen to a tensile test according to JIS Z 2241. The yield elongation YPEl is a yield elongation quantity determined by taking out a JIS No. 5 test specimen in a direction (C-direction) perpendicular to the rolling direction and subjecting the test specimen to an acceleration aging treatment at 50° C. for 90 days and thereafter to a tensile test according to JIS Z2241. The TS ratio is a ratio ($TS_D/TS_C$) of tensile strength $TS_D$ in D-direction to tensile strength $TS_C$ in C-direction obtained by taking out JIS No. 5 test specimens in a direction (C-direction) perpendicular to the rolling direction and in a direction 45° with respect to the rolling direction (D-direction) and subjecting each specimen to a tensile test according to JIS Z2241. The reason why the anisotropy is evaluated by ($TS_D/TS_C$) is due to the fact that the difference between tensile strengths in the direction perpendicular to the rolling direction (C-direction) and in the direction 45° with respect to the rolling direction (D-direction) is the largest in the cold rolled steel sheets containing martensite.

The steel structure of the cold rolled steel sheet will be described below.

The cold rolled steel sheet is necessary to have a steel structure that an area ratio of ferrite is not less than 85% and an area ratio of martensite falls is 3-15% and an area ratio of unrecrystallized ferrite is not more than 5% and an average crystal grain size d of the ferrite is 2-8 μm and a ratio (L/d) of an average value L (μm) of intervals between martensite grains closest to each other with respect to the average crystal grain size d of the ferrite is 0.20-0.80.

Moreover, the area ratio of above each structure in the steel structure of the cold rolled steel sheet is measured by observing a cross section parallel to the rolling direction (L-section) positioned ¼ sheet thickness from the surface of the steel sheet by a SEM and using a point count method defined in ASTM E562-05. The average crystal grain size d of ferrite is an average value of grain sizes of equivalent circles calculated from an observed area of SEM observed image and number of crystal grains. The interval L between martensite grains closest to each other is an average separated distance between the martensite grains closest to each other measured by analyzing the SEM observed image over a range of not less than 5000 $\mu m^2$ with a grain analysis software.

Ferrite: Not Less than 85%

Ferrite is a structure being a main phase in the steel structure of the cold rolled steel sheet and is necessary to have an area ratio of not less than 85% to ensure a good ductility. When it is less than 85%, a ratio of martensite and the like increases. Hence, there is a fear that the tensile strength exceeds a targeted strength range. Therefore, the area ratio of ferrite is not less than 85%, preferably not less than 90%.

Martensite: 3-15%

Martensite is a hard structure that increases a tensile strength of a product sheet and also an important structure contributing to the improvement of the aging resistance. When the area ratio of martensite is less than 3%, the interval L between martensite grains closest to each other of martensite increases and L/d exceeds 0.80, and hence the aging resistance is deteriorated. On the other hand, when the area ratio of martensite exceeds 15%, the tensile strength excessively increases as compared to yield stress. Hence, the yield ratio is decreased. Therefore, the area ratio of martensite is 3-15%, preferably 5-12%.

Unrecrystallized Ferrite: Not More than 5%

Unrecrystallized ferrite is an undesirable structure that badly affects the anisotropy of tensile strength. The area ratio of the unrecrystallized ferrite is necessary to be not more than 5% so that a ratio ($TS_D/TS_C$), or a TS ratio of tensile strength $TS_D$ in the direction 45° with respect to the rolling direction to tensile strength $TS_C$ in the direction 90° with respect to the rolling direction is not less than 0.95. The smaller amount of the unrecrystallized ferrite is more preferable. It is preferably not more than 3%, more preferably 0%.

The cold rolled steel sheet may contain bainite, pearlite and residual austenite with a total area ratio of not more than 5%, in addition to the aforementioned steel structures. More preferably, the total area ratio is not more than 3%. The desired effect is not damaged within the above range. Moreover, the total area ratio includes 0%.

Average Crystal Grain Size of Ferrite d: 2-8 μm

In the cold rolled steel sheet, the average crystal grain size of ferrite is an important factor in attaining both the yield ratio of not less than 0.68 and the excellent aging resistance. When the average crystal grain size d of ferrite is less than 2 μm, L/d exceeds 0.80, leading to the deterioration of the aging resistance. On the other hand, when the average crystal grain size of ferrite exceeds 8 μm, the yield stress YS is decreased, and hence the yield ratio YR of not less than 0.68 cannot be ensured. Therefore, the average crystal grain size of ferrite is 2-8 μm. Preferably, it is 3-7 μm.

L/d: 0.20-0.80

A ratio (L/d) of an average value L (μm) of intervals between martensite grains closest to each other with respect to the average crystal grain size d (μm) of ferrite is an important factor in providing an excellent aging resistance. Although the reason is not exactly clear, we believe that when martensite is formed, a compression stress field is generated in ferrite surrounding the martensite by volume expansion in transformation to possibly exert some influence. However, when L/d is less than 0.20, martensite is divided by bainite or the like and not uniformly dispersed into ferrite base. Hence, the above effect is not obtained and the aging resistance is deteriorated. On the other hand, when L/d exceeds 0.80, distances between martensite grains become too larger compared to the average crystal grain size of ferrite, and sufficient compression stress is not applied to ferrite. Hence, the aging resistance is deteriorated. Accordingly, L/d is 0.20-0.80. Preferably, it is 0.30-0.60.

The reason of limiting the chemical composition in the cold rolled steel sheet will be described below.

The cold rolled steel sheet has a basic chemical composition comprising C: 0.06-0.14 mass %, Si: less than 0.50 mass %, Mn: 1.6-2.5 mass %, P: not more than 0.10 mass %, S: not more than 0.020 mass %, Al: 0.01-0.10 mass %, N: not more than 0.010 mass %, Nb: not more than 0.080 mass % (including 0 mass %) and Ti: not more than 0.080 mass % (including 0 mass %), provided that Nb and Ti are contained in an amount of 0.020-0.080 mass % in total. The details will be explained below.

C: 0.06-0.14 Mass %

C is an element effective to increase yield stress and tensile strength because it increases the fraction of martensite in the steel structure. C also contributes to the improvement of the aging resistance through a dispersion form of martensite. When C content is less than 0.06 mass %, an area ratio of martensite is less than 3%, and martensite is not finely dispersed into ferrite base so that the targeted excellent aging resistance cannot be obtained. On the other hand, when C content exceeds 0.14 mass %, martensite is excessively formed to largely increase the tensile strength compared to the yield stress so that the targeted high yield ratio cannot be obtained. Therefore, C is 0.06-0.14 mass %. Preferably, it is 0.07-0.12 mass %.

Si: Less than 0.50 Mass %

Si is an element effective to increase yield stress and tensile strength because it strengthens ferrite through solid-solution. However, Si is concentrated on the steel sheet surface during soaking annealing in continuous annealing to form oxides and degrade surface quality of a product sheet so that Si content is limited to less than 0.50 mass %. It is preferably not more than 0.30 mass %, more preferably less than 0.30 mass %, further preferably less than 0.25 mass %. Moreover, the yield stress and the tensile strength can be increased by a method other than adding Si so that Si may not be positively added. Moreover, the lower limit of Si is preferably 0.005 mass % from a viewpoint of melting cost.

Mn: 1.6-2.5 Mass %

Mn is an element effective to increase yield stress and tensile strength because it increases a fraction of martensite in the steel structure. However, when Mn content is less than 1.6 mass %, the above effect is small, and the area ratio of martensite is less than 3% so that the excellent aging resistance cannot be obtained. On the other hand, when Mn content exceeds 2.5 mass %, martensite is excessively formed to decrease the yield ratio. Therefore, Mn content is 1.6-2.5 mass %. Preferably, it is 1.8-2.3 mass %.

P: Not More than 0.10 Mass %

P is an element effective to increase yield stress and tensile strength because it strengthens ferrite through solid-solution, and can be added properly to obtain such an effect. P is preferably added in an amount of not less than 0.001 mass % to provide the above effect. However, when P is added, exceeding 0.10 mass %, not only the solid-solution strengthening effect is saturated, but also the spot weldability is deteriorated. The surface quality of the product sheet is also deteriorated in a hot-dip galvanized steel sheet or an alloyed hot-dip galvanized steel sheet. Therefore, P content is limited to not more than 0.10 mass %. It is preferably not more than 0.030 mass %, further preferably not more than 0.020 mass %. S: not more than 0.020 mass %

S is an impurity element inevitably incorporated into steel during the refining process and forms inclusions such as MnS or the like, whereby the ductility in the hot rolling is degraded to cause surface defects and damage the surface quality of the product sheet. Thus, it is preferable to be decreased as far as possible. Therefore, S is limited to not more than 0.020 mass %. It is preferably not more than 0.010 mass %, further preferably not more than 0.005 mass %. Moreover, the lower limit of S is preferably not more than 0.0001 mass % from a viewpoint of melting cost.

Al: 0.01-0.10 Mass %

Al is an element added as a deoxidizing agent in the refining process and also added to fix solid-soluted N as AlN. To sufficiently obtain such an effect, Al is necessary to be added in an amount of not less than 0.01 mass %. On the other hand, when Al addition amount exceeds 0.10 mass %, there is a fear that coarse AlN is precipitated in the casting solidification to cause surface defects such as slab cracking and the like. Therefore, Al content is 0.01-0.10 mass %. It is preferably 0.01-0.07 mass %, further preferably of 0.01-0.06 mass %.

N: Not More than 0.010 Mass %

N is an impurity element inevitably incorporated into steel in the refining process. When N content exceeds 0.010 mass %, coarse Nb carbonitride and/or Ti carbonitride are/is precipitated in the casting solidification and it is feared that cracking is caused in the surface of the slab during the re-bending of the cast slab in the continuous casting or the coarse precipitates remain as they are without being sufficiently melted even in the re-heating of the slab conducted before the hot rolling to bring about the deterioration of the formability in the product sheet. Therefore, N content is limited to not more than 0.010 mass %. It is preferably not more than 0.005 mass %. Moreover, the lower limit of N content is preferably 0.0005 mass % from a viewpoint of melting cost.

Nb: Not More than 0.080 Mass % (Including 0 Mass %), Ti: Not More than 0.080 Mass % (Including 0 Mass %), Nb and Ti: 0.020-0.080 Mass % in Total Nb and Ti are important elements that precipitate as Nb carbonitride and Ti carbonitride during heating or soaking in the continuous annealing, respectively, to thereby contribute to making the average crystal grain of ferrite finer and increasing the yield ratio. Both elements have the above effects equivalently to each other. When the total amount of Nb and Ti is less than 0.020 mass %, the precipitation amount of Nb carbonitride and Ti carbonitride is small, and ferrite is coarsened in the continuous annealing, and the average crystal grain size of fine ferrite is not obtained so that the targeted high yield ratio cannot be obtained. On the other hand, when the total amount of Nb and Ti exceeds 0.080 mass %, not only the above effects are saturated, but also a large amount of unrecrystallized ferrite remains in the product sheet so that the tensile strength is increased and the anisotropy of tensile strength is also increased. It also feared that coarse Nb carbonitride and/or Ti carbonitride are/is produced in the casting solidification to cause slab cracking or the precipitated Nb carbonitride and/or Ti carbonitride are/is not sufficiently dissolved in the re-heating of the slab and surface defects are caused in the product sheet. Therefore, it is necessary that Nb is not more than 0.080 mass % (including 0 mass %) and Ti is not more than 0.080 mass % (including 0 mass %), provided that the total amount of Nb and Ti is 0.020-0.080 mass %. It is preferable that Nb is not more than 0.060 mass % (including 0 mass %) and Ti is not more than 0.060 mass % (including 0 mass %) and the total amount of Nb and Ti is 0.030-0.060 mass %. It is further preferable that Nb is not more than 0.050 mass % (including 0 mass %) and Ti is not more than 0.050 mass % (including 0 mass %) and the total amount of Nb and Ti is 0.030-0.050 mass %.

The cold rolled steel sheet may further contain, in addition to the above basic ingredients, one or more selected from Cr: not more than 0.3 mass %, Mo: not more than 0.3 mass %, B: not more than 0.005 mass %, Cu: not more than 0.3 mass %, Ni: not more than 0.3 mass % and Sb: not more than 0.3 mass % as an arbitrary ingredient.

Cr: Not More than 0.3 Mass %

Cr can be added because it has an effect of improving the hardenability and increasing martensite. To obtain such an effect, it is preferable to be added in an amount of not less than 0.02 mass %. When it exceeds 0.3 mass %, however, hardenability is too improved and martensite is excessively formed, and thus, there is a fear of decreasing the yield ratio. It is also feared that Cr is concentrated on the surface of the steel sheet during the continuous annealing to form oxides excessively, causing deterioration of the surface quality. When Cr is added, therefore, the upper limit is preferable to be 0.3 mass %. More preferably, it is not more than 0.2 mass %.

Mo: Not More than 0.3 Mass %

Mo can be added because it has an effect of improving the hardenability and increasing martensite. To obtain such an effect, it is preferable to be added in an amount of not less than 0.02 mass %. However, when it exceeds 0.3 mass %, the hardenability is significantly improved, and martensite is excessively formed, and hence there is a fear of decreasing the yield ratio. It is also feared that the phosphatability is deteriorated when the product sheet is a cold rolled steel sheet. When Mo is added, therefore, it is preferably not more than 0.3 mass %. More preferably, it is not more than 0.2 mass %.

B: Not More than 0.005 Mass %

B can be added because it has an effect of improving the hardenability and increasing martensite. To obtain such an effect, it is preferable to be added in an amount of not less than 0.0005 mass %. However, when it exceeds 0.005 mass %, the hardenability is significantly improved and martensite is excessively produced. Hence, there is a fear of decreasing the yield ratio. When B is added, therefore, it is preferably not more than 0.005 mass %. More preferably, it is not more than 0.002 mass %.

Cu: Not More than 0.3 Mass %

Cu can be added because it has an effect of improving the hardenability and increasing martensite. To obtain such an effect, it is preferable to be added in an amount of not less than 0.02 mass %. However, when it exceeds 0.3 mass %, the hardenability is significantly improved and martensite is excessively produced. Hence, there is a fear of decreasing the yield ratio. Moreover, when the product sheet is a cold rolled steel sheet, it is feared that the phosphatability is deteriorated. When the product sheet is an alloyed hot-dip galvanized steel sheet, alloying reaction is delayed. Hence, there is a fear of increasing the temperature in the alloying treatment. When Cu is added, therefore, it is preferably not more than 0.3 mass %. More preferably, it is not more than 0.2 mass %.

Ni: Not More than 0.3 Mass %

Ni can be added because it has an effect of improving the hardenability and increasing martensite. To obtain such an effect, it is preferable to be added in an amount of not less than 0.02 mass %. However, when it exceeds 0.3 mass %, the hardenability is significantly improved and martensite is excessively produced. Hence. there is a fear of decreasing the yield ratio. When Ni is added, therefore, it is preferably not more than 0.3 mass %. More preferably, it is not more than 0.2 mass %.

Sb: Not More than 0.3 Mass %

Sb can be added because it has an effect of improving the hardenability and increasing martensite. To obtain such an effect, it is preferable to be added in an amount of not less than 0.0005 mass %. However, when it exceeds 0.3 mass %, there is a fear of causing embrittlement of steel to decrease the bending property of the product sheet. When Sb is added, therefore, the addition amount is preferably not more than 0.3 mass %. More preferably, it is not more than 0.02 mass %.

The remainder other than the above ingredients is Fe and inevitable impurities. In the cold rolled steel sheet, Sn, Co, W, Ca, Na and Mg may be contained in an amount of not more than 0.01 mass % in total as inevitable impurities, in addition to the abovementioned ingredients.

Next, the method of manufacturing the cold rolled steel sheet will be described.

The cold rolled steel sheet is manufactured by melting a steel having the above chemical composition through conventionally well-known refining process to form a steel slab (billet), hot rolling the slab to form a hot rolled sheet, pickling for descaling, cold rolling to obtain a cold rolled sheet having a given thickness, and then subjecting the cold rolled sheet to continuous annealing to apply a given steel structure and mechanical properties. The steel sheet subjected to the continuous annealing may be used as a product sheet of a cold rolled steel sheet (CR) as it is. The cold rolled steel sheet may be electrogalvanized to form an electrogalvanized steel sheet (GE). A hot-dip galvanizing process may be incorporated into the continuous annealing process to form a hot-dip galvanized steel sheet (GI), and further, an alloying treatment may be applied to the hot-dip galvanized steel sheet to form an alloyed hot-dip galvanized steel sheet (GA). Moreover, temper rolling or the like may be applied to the steel sheet after the continuous annealing or zinc-based plating. The details will be explained below.

The steel slab (billet) as a raw material for the cold rolled steel sheet can be produced by subjecting a molten steel blown in a convertor or the like to a secondary refining in a vacuum degassing apparatus or the like to have the above predetermined chemical composition and then conducting the conventionally well-known method such as an ingot making-blooming method, a continuous casting method or the like. The production method is not particularly limited as long as a significant compositional segregation or non-uniform structure is not caused.

In the subsequent hot rolling, the high-temperature cast slab may be directly subjected to rolling (direct rolling), or the slab may be cooled to room temperature and then rolled after reheating. The temperature for reheating the slab is preferably not lower than 1100° C., more preferably not lower than 1150° C. as a slab surface temperature to sufficiently solid-solute Nb carbonitride and Ti carbonitride precipitated in the slab.

In the hot rolling, the steel slab is subjected to rough rolling and then finish rolling to form a hot rolled sheet having a given thickness, which is cooled to a given temperature and wound into a coil. The rough rolling may be conducted according to the usual manner and is not particularly limited, while the finish rolling is preferable to be conducted in a manner that a rolling end temperature FT is not lower than the $Ar_3$ transformation point. When the finish rolling end temperature is lower than the $Ar_3$ transformation point, rolling texture containing coarse ferrite grains elongated in the rolling direction is formed in the steel structure of the hot rolled sheet, causing a fear of deteriorating the ductility of the product sheet or decreasing the TS ratio. The rolling end temperature FT adopts a surface temperature of the steel sheet. The $Ar_3$ transformation point means a temperature at which ferrite transformation starts when continuous cooling is performed from the single phase temperature range of austenite at a rate of 1° C./s by using a transformation point measuring device such as a Formastor testing machine or the like, for example.

Cooling after the hot rolling is preferably conducted in a manner that a retention time in a temperature range from the finish rolling end temperature to 600° C. is within 10 seconds, the reason of which is not clear. When the retention time exceeds 10 seconds, only a part of nuclei (embryo) of Nb carbonitride and/or Ti carbonitride, which are/is formed subsequent to the formation of ferrite after the finish rolling, is grown and coarsened, and hence Nb carbonitride and/or Ti carbonitride grown at a relatively low temperature range after the coiling exists at a mixed state with fine precipitates of Nb carbonitride and/or Ti carbonitride nucleated and grown after the coiling so that there is a possibility that scattering of tensile strength in the widthwise direction of the sheet increases. Moreover, the lower limit of the retention time in the above temperature range is preferable to be not less than 2 seconds from a viewpoint that nuclei of Nb carbonitride and/or Ti carbonitride are/is uniformly formed in the widthwise direction of the sheet before the coiling and Nb carbonitride and/or Ti carbonitride are/is uniformly grown and dispersed after the coiling and in the subsequent continuous annealing to reduce the scattering of tensile strength in the widthwise direction of the sheet.

Also, the coiling temperature CT is preferable to be controlled to a range of 600-500° C. from a viewpoint that Nb carbonitride and/or Ti carbonitride are/is uniformly precipitated to reduce the scattering of tensile strength in the widthwise direction of the steel sheet. When the coiling temperature is lower than 500° C., the precipitation of Nb carbonitride and/or Ti carbonitride is not caused sufficiently in the widthwise end portion of the sheet, the temperature of which is easily decreased during the cooling after the coiling, and coarse Nb carbonitride and/or Ti carbonitride are/is precipitated in the heating and soaking of the subsequent continuous annealing, and hence the tensile strength in the widthwise end portion of the sheet is decreased to increase the scattering of tensile strength in the widthwise direction of the sheet. On the other hand, when the coiling temperature exceeds 600° C., coarse carbonitride of Nb and/or Ti are/is precipitated in a widthwise central portion of the sheet, where the temperature is high, during the cooling after the coiling. Hence, the tensile strength is decreased to increase the scattering of tensile strength in the widthwise direction of the sheet.

Then, the steel sheet subjected to the hot rolling (hot rolled sheet) is preferably pickled and cold rolled with a rolling reduction of 35-80% to form a cold rolled sheet having a given thickness. When the rolling reduction is less than 35%, the recrystallization of ferrite in the continuous annealing tends to be insufficient, and the anisotropy of tensile strength is increased and uniform elongation is reduced to bring about the deterioration of the formability. On the other hand, when the rolling reduction exceeds 80%, the rolling texture of ferrite is excessively grown to increase the anisotropy of tensile strength. More preferably, it is 40-75%.

Thereafter, the steel sheet subjected to the cold rolling (cold rolled sheet) is subjected to a continuous annealing to cause recrystallization of the rolled steel structure and apply a given steel structure and mechanical properties to the product sheet.

It is important that the continuous annealing comprises: heating the sheet to a temperature of 840-940° C.; performing soaking annealing by holding the sheet in this temperature range for 30-120 seconds; performing primary cooling by cooling from the soaking temperature to 600° C. at an average cooling rate of not less than 5° C./s; retaining the sheet at a temperature of 600-500° C. for 30-300 seconds; and performing a secondary cooling by cooling the sheet to not higher than 100° C.

The heating rate up to the soaking temperature is preferably not less than 2° C./s from a viewpoint of suppressing excessive crystal grain growth of ferrite and ensuring the productivity. It is more preferably not less than 3° C./s. The upper limit of the heating rate up to the soaking temperature is not particularly limited, but is preferably not more than 50° C./s because the heating can be conducted by a radiant tube system, a direct heating system or a combination thereof without requiring enormous investment for installation such as induction heating device or the like.

Soaking Temperature: 840-940° C.

The soaking annealing temperature in the continuous annealing is an important factor in causing recrystallization of the rolling structure sufficiently. Also, the soaking annealing performed in the above temperature range allows formation of austenite, which is moderately transferred to ferrite in the retention in a temperature range of 600-500° C., whereby a given martensite fraction and an interval between martensite grains closest to each other are obtained in the product sheet. When the soaking temperature is lower than 840° C., the rolling structure is not recrystallized sufficiently and the unrecrystallized ferrite remains so that the anisotropy of tensile strength is increased. Also, since austenite in the soaking annealing is dispersed into the unrecrystallized ferrite base, distribution of austenite becomes non-uniform, and the interval between martensite grains closest to each other exceeds a given range. On the other hand, when the soaking temperature exceeds 940° C., the average crystal grain size of the recrystallized ferrite is coarsened, and the desired yield ratio cannot be obtained. Therefore, the soaking temperature is preferably 850-900° C.

Soaking Time: 30-120 Seconds

The soaking annealing time in the continuous annealing is an important factor, similarly to the soaking temperature, in causing recrystallization of the rolling structure sufficiently and producing austenite necessary to obtain the given martensite fraction and is necessary to fall within the range of 30-120 seconds. When the soaking time is less than 30 seconds, a large amount of unrecrystallized ferrite remains to increase the anisotropy of tensile strength. On the other hand, when the soaking time exceeds 120 seconds, the average grain size of the recrystallized ferrite is coarsened and an average grain size of ferrite in the product sheet exceeds 8 μm. Therefore, the soaking annealing time preferably is 40-100 seconds.

An atmosphere in the soaking annealing is preferably a reducing atmosphere such as a mixed atmosphere of nitrogen and hydrogen or the like from a viewpoint of ensuring an appearance quality of the steel sheet surface. In particular, a dew point in the soaking is desirable to be lower from a viewpoint that concentration of Mn, Si and so on onto the steel sheet surface is prevented to suppress temper color and ensure subsequent plating property, and is preferably not higher than −35° C., more preferably not higher than −40° C.

Average Cooling Rate in Primary Cooling to 600° C.: Not Less than 5° C./s

The primary cooling from the soaking temperature to 600° C. in the continuous annealing is an important factor so that excessive transformation of austenite is suppressed by cooling to a temperature of not higher than 600° C. while keeping the austenite fraction obtained in the soaking and that fine austenite is dispersed into ferrite base in the retention in the temperature range of 600-500° C. and a given martensite fraction is obtained in the subsequent secondary cooling so that an average cooling rate is necessary to be not less than 5° C./s. When the average cooling rate is less than 5° C./s, austenite is transformed into ferrite and subsequently to pearlite during the cooling, whereby decomposition of austenite is excessively promoted during the primary cooling or up to the secondary cooling described later, and hence martensite cannot be obtained with an area ratio of not less than 3% in the product sheet. The preferable average cooling rate is not less than 10° C./s. The upper limit of the average cooling rate is preferably 100° C./s.

The upper limit of the average cooling rate is not particularly limited, but is preferably about 100° C./s, for which heavy capital investment is not necessary. The cooling method is not also particularly limited and can adopt a gas jet cooling, roll cooling, mist cooling, steam-water cooling or a combination thereof.

Retention Time in the Temperature Range of 600-500° C.: 30-300 Seconds

It is important that the sheet is retained at a temperature of 600-500° C. for 30-300 seconds after the primary cooling so that the steel sheet structure of the product sheet has the desired martensite fraction and interval between martensite grains closest to each other by the secondary cooling described later. The reason why the retention temperature range is 600-500° C. is due to the fact that when the retention temperature exceeds 600° C., the ferrite nucleation is sparsely caused in the transformation of austenite into ferrite. Hence, the interval between martensite grains closest to each other exceeds the given range. On the other hand, when it is lower than 500° C., austenite is transformed into bainite to form a dispersion state of austenite divided by bainite. Hence, the interval between martensite grains closest to each other obtained after the secondary cooling is less than the given range.

Further, the reason why the retention time in the above temperature range is 30-300 seconds is due to the fact that the ferrite nucleation from austenite is caused uniformly and finely within the retaining time and austenite is isotropically shrunk and uniformly dispersed into ferrite base. Accordingly, it is possible to obtain the martensite fraction and the interval between martensite grains closest to each other by performing secondary cooling at this state to cause transformation of austenite into martensite. However, when the retention time in the above temperature range is less than 30 seconds, the transformation of austenite into ferrite is not promoted sufficiently and martensite is formed with an area ratio exceeding 15% by the subsequent secondary cooling, and thus the desired high yield ratio cannot be obtained. On the other hand, when the retention time in the above temperature range exceeds 300 seconds, the decomposition of austenite is excessively promoted, and as a result, the desired martensite fraction cannot be ensured by the subsequent secondary cooling, and the aging resistance is deteriorated. Therefore, the retention time preferably is 45-180 seconds. The retention time in the above temperature range means a total time during which the steel sheet is retained at 600 to 500° C. in the cooling process, irrespective of whether it is during cooling or temperature retaining.

Secondary Cooling

The steel sheet retained at a temperature of 600-500° C. for 30-300 seconds is necessary to be subjected to secondary cooling subsequent to the retention temperature range so that austenite, which is uniformly and finely dispersed into ferrite base by the above retention, is transformed into martensite to obtain such a steel structure that martensite having a given fraction is uniformly and finely dispersed into ferrite base at the given interval between grains closest to each other. The end temperature of the secondary cooling is preferably a temperature of not higher than 100° C. causing no tempering of the resulting martensite.

The average cooling rate of the secondary cooling is not particularly limited because C and Mn are concentrated into austenite up to the secondary cooling and thermal stability of austenite is very high, but is preferably 5-100° C./s. When the average cooling rate is less than 5° C./s, austenite is transformed into bainite and the given martensite fraction may not be obtained. On the other hand, the average cooling rate exceeding 100° C./s is not preferable, because it needs a large capital investment.

Moreover, the cooling means for the secondary cooling is not particularly limited and can adopt gas jet cooling, roll cooling, mist cooling, steam-water cooling, water cooling or a combination thereof.

The timing of conducting the secondary cooling is different in accordance with whether the target product sheet is a cold rolled steel sheet, an electrogalvanized steel sheet, a hot-dip galvanized steel sheet or an alloyed hot-dip galvanized steels sheet.

In a Cold Rolled Steel Sheet or Electrogalvanized Steel Sheet

When the product sheet is a cold rolled steel sheet CR, the secondary cooling is conducted immediately after the retention at 600-500° C. for 30-300 seconds. When the product sheet is an electrogalvanized steel sheet GE, electrogalvanizing is performed after the steel sheet is retained at a temperature of 600-500° C. for 30-300 seconds and immediately subjected to the secondary cooling.

In a Hot-Dip Galvanized Steel Sheet

When the product sheet is a hot-dip galvanized steel sheet GI, the sheet is retained at 600-500° C. for 30-300 seconds and introduced into a hot-dip galvanizing bath which is held at a temperature of 460-500° C. to conduct hot-dip galvanizing and thereafter subjected to the secondary cooling.

In an Alloyed Hot-Dip Galvanized Steel Sheet

When the product sheet is an alloyed hot-dip galvanized steel sheet, the sheet is retained at 600-500° C. for 30-300 seconds, introduced into a hot-dip galvanizing bath held at a temperature of 460-500° C. to conduct hot-dip galvanizing, and subjected to an alloying treatment and then the secondary cooling. In general, the alloying treatment is performed by holding the sheet within temperature of 460-560° C. for 5-30 seconds. When the holding temperature is lower than 450° C. and/or the holding time is less than 5 seconds, the alloying is not promoted sufficiently and the plating adhesiveness and corrosion resistance are deteriorated. On the other hand, when the holding temperature exceeds 560° C. and/or the holding time exceeds 30 seconds, the alloying is excessively promoted and there is a fear of causing troubles such as powdering or the like in the press forming of the steel sheet. Moreover, the holding time of the alloying treatment does not include the aforementioned retention time at 600-500° C., but when the alloying temperature is not lower than 500° C., it is preferable to control the total inclusive of the above retention time to not more than 300 seconds.

The thus obtained steel sheet such as a cold rolled steel sheet or zinc-based steel sheet may be further subjected to temper rolling at a stretching ratio of 0.1-3.0% for the purpose of shape correction of the product sheet and so on. When the stretching ratio is less than 0.1%, the shape correction cannot be attained sufficiently. On the other hand, when it exceeds 3.0%, the shape of the product sheet may be rather deteriorated. Thus, the stretching ratio is preferably 0.1-3.0%. Also, the steel sheet may be further subjected to a phosphating treatment, a surface treatment such as an organic coating treatment and the like, and a painting treatment.

EXAMPLES

Each of steel slabs A-P having various chemical compositions shown in Table 1 is heated and retained to a temperature of 1250° C. for 1 hour and subjected to a hot rolling with a finish rolling end temperature of 900° C., which is higher than $Ar_3$ point, to obtain a hot rolled sheet having a thickness of 3.2 mm, which is cooled to 540° C. and wound in a coil. Then, the hot rolled sheet is pickled and cold rolled to obtain a cold rolled sheet having a thickness of 1.4 mm, which is subjected to a continuous annealing under various conditions shown in Table 2 to obtain a cold rolled steel sheet CR, subjected to continuous annealing and hot-dip galvanizing to obtain a hot-dip galvanized steel sheet GI, or subjected to continuous annealing, hot-dip galvanizing and then an alloying treatment to obtain an alloyed hot-dip galvanized steel sheet GA.

In the continuous annealing, the sheet is heated from 20° C. to a soaking temperature at an average heating rate of 4° C./s. The bath temperature in the hot-dip galvanizing is 470° C., and the subsequent alloying treatment is conducted by holding at 500° C. for 15 seconds.

Each of the thus-obtained cold rolled steel sheets, hot-dip galvanized steel sheets and alloyed hot-dip galvanized steel sheets is subjected to a temper rolling at a stretching ratio of 0.5% to form product sheets No. 1-29.

A test specimen is taken out from each widthwise center of thus obtained product sheets No. 1-29 to evaluate steel structure and mechanical properties by the following methods.

Steel Structure

Area Ratio of Ferrite, Martensite, Unrecrystallized Ferrite and Another Structures The test specimen taken out from the widthwise center is observed on a section parallel to the rolling direction (L-section) positioned ¼ sheet thickness from the surface of the steel sheet by a SEM over the region of 5000 $\mu m^2$ to obtain the area ratio of each structure with a point count method defined in ASTM E562-05.

Average Crystal Grain Size d of Ferrite

A ferrite grain size of an equivalent circle is obtained from the observed area and crystal grain number in SEM observed image over the region of 5000 $\mu m^2$.

Interval L Between Martensite Grains Closest to Each Other

It is measured by analyzing the SEM image observed over the region of 5000 $\mu m^2$ with a grain analysis software.

Mechanical Properties

Tensile Strength TS and Yield Ratio YR

A JIS No. 5 tensile specimen having a direction perpendicular to the rolling direction (C-direction) as a tensile direction is prepared from the test specimen taken out from the widthwise center and subjected to a tensile test according to JIS Z2241 to measure yield stress YS and tensile strength TS, from which a yield ratio YR is measured.

Aging Resistance

A JIS No. 5 tensile specimen having a direction perpendicular to the rolling direction (C-direction) as a tensile direction is prepared from the test specimen taken out from the widthwise center and subjected to an acceleration aging treatment by holding at 50° C. for 90 days. The specimen is then subjected to a tensile test according to JIS Z2241 to measure a yield elongation YPEl.

TS Ratio

JIS No. 5 tensile specimens having a tensile direction in a direction (C-direction) perpendicular to the rolling direction and in a direction 45° with respect to the rolling direction (D-direction) are prepared from the test specimen taken out from the widthwise center and subjected to a tensile test according to JIS Z2241 to measure a ratio ($TS_D/TS_C$) of tensile strength in D-direction $TS_D$ to tensile strength in C-direction $TS_C$.

TABLE 1

| Steel | Chemical composition (mass %) | | | | | | | | | | | |
|---|---|---|---|---|---|---|---|---|---|---|---|---|
| symbol | C | Si | Mn | P | S | Al | N | Nb | Ti | Nb + Ti | Others | Remarks |
| A | 0.08 | 0.15 | 2.0 | 0.02 | 0.001 | 0.033 | 0.002 | 0.025 | 0.020 | 0.045 | | Example steel |
| B | 0.12 | 0.05 | 1.8 | 0.01 | 0.002 | 0.027 | 0.003 | 0.025 | 0.020 | 0.045 | — | Example steel |
| C | 0.07 | 0.03 | 2.3 | 0.02 | 0.001 | 0.032 | 0.002 | 0.025 | 0.020 | 0.045 | | Example steel |
| D | 0.07 | 0.18 | 1.8 | 0.01 | 0.001 | 0.034 | 0.002 | 0.035 | — | 0.035 | — | Example steel |
| E | 0.09 | 0.03 | 1.9 | 0.01 | 0.001 | 0.016 | 0.002 | — | 0.055 | 0.055 | B:0.0010 | Example steel |
| F | 0.07 | 0.02 | 1.9 | 0.01 | 0.002 | 0.026 | 0.003 | 0.010 | 0.015 | 0.025 | — | Example steel |
| G | 0.09 | 0.12 | 1.8 | 0.02 | 0.001 | 0.034 | 0.003 | 0.035 | 0.035 | 0.070 | — | Example steel |
| H | 0.07 | 0.17 | 2.0 | 0.01 | 0.002 | 0.015 | 0.003 | 0.025 | 0.020 | 0.045 | Cr:0.15, Mo:0.10 | Example steel |
| I | 0.09 | 0.13 | 1.9 | 0.01 | 0.001 | 0.031 | 0.005 | 0.025 | 0.020 | 0.045 | Cu:0.20, Ni:0.10 | Example steel |
| J | 0.10 | 0.10 | 2.1 | 0.01 | 0.002 | 0.015 | 0.004 | 0.025 | 0.020 | 0.045 | Sb:0.0010 | Example steel |
| K | 0.04 | 0.12 | 2.1 | 0.01 | 0.002 | 0.025 | 0.003 | 0.025 | 0.020 | 0.045 | — | Comparative steel |
| L | 0.11 | 0.07 | 1.3 | 0.01 | 0.001 | 0.032 | 0.005 | 0.025 | 0.020 | 0.045 | | Comparative steel |
| M | 0.08 | 0.16 | 2.7 | 0.01 | 0.002 | 0.022 | 0.003 | 0.025 | 0.020 | 0.045 | | Comparative steel |
| N | 0.07 | 0.08 | 1.9 | 0.02 | 0.001 | 0.021 | 0.003 | 0.005 | 0.010 | 0.015 | | Comparative steel |
| O | 0.09 | 0.13 | 2.0 | 0.01 | 0.002 | 0.034 | 0.003 | 0.100 | 0.010 | 0.110 | — | Comparative steel |
| P | 0.08 | 0.60 | 2.0 | 0.02 | 0.002 | 0.031 | 0.003 | 0.025 | 0.020 | 0.045 | — | Comparative steel |

TABLE 2

| | | Continuous annealing conditions | | | | | Steel structure | | | | | | | Mechanical properties | | | | |
|---|---|---|---|---|---|---|---|---|---|---|---|---|---|---|---|---|---|---|
| No | Steel symbol | Soaking temperature (° C.) | Soaking time (s) | Cooling rate to 600° C. (° C./s) | Retention time from 600 to 500° C. (s) | Product sheet type | Area ratio of α (%) | M Area ratio (%) | Area ratio of unrecrystallized α (%) | Residual structure (%)*3 | Average grain sized d of α (μm) | L*1 (μm) | L/d (—) | TS (Mpa) | YR (—) | TS ratio (—) | YPE1 after aging (%) | Remarks |
| 1 | A | 870 | 60 | 25 | 100 | GA | 91 | 9 | 0 | 0 | 5.4 | 3.1 | 0.57 | 635 | 0.74 | 0.96 | 0 | Example |
| 2 | B | 870 | 60 | 25 | 100 | GA | 88 | 12 | 0 | 0 | 5.3 | 2.9 | 0.55 | 715 | 0.70 | 0.97 | 0 | Example |
| 3 | C | 870 | 60 | 20 | 150 | GA | 89 | 11 | 0 | 0 | 5.4 | 3.0 | 0.56 | 756 | 0.69 | 0.97 | 0 | Example |
| 4 | D | 870 | 80 | 25 | 100 | GI | 90 | 10 | 0 | 0 | 5.8 | 3.1 | 0.53 | 645 | 0.73 | 0.96 | 0 | Example |
| 5 | E | 870 | 80 | 25 | 100 | CR | 89 | 11 | 0 | 0 | 6.1 | 2.7 | 0.44 | 630 | 0.77 | 0.96 | 0 | Example |
| 6 | F | 860 | 80 | 25 | 100 | GA | 92 | 8 | 0 | 0 | 6.8 | 3.2 | 0.47 | 623 | 0.69 | 0.96 | 0 | Example |
| 7 | G | 880 | 80 | 25 | 100 | GA | 90 | 10 | 0 | 0 | 4.1 | 2.7 | 0.66 | 677 | 0.79 | 0.97 | 0 | Example |
| 8 | H | 870 | 60 | 25 | 100 | GA | 88 | 12 | 0 | 0 | 5.3 | 2.8 | 0.53 | 638 | 0.73 | 0.96 | 0 | Example |
| 9 | I | 870 | 60 | 25 | 100 | GI | 90 | 10 | 0 | 0 | 5.2 | 2.8 | 0.54 | 641 | 0.72 | 0.96 | 0 | Example |
| 10 | J | 870 | 60 | 25 | 100 | GI | 88 | 12 | 0 | 0 | 6.0 | 3.4 | 0.57 | 633 | 0.70 | 0.96 | 0 | Example |
| 11 | K | 880 | 60 | 25 | 100 | CR | 92 | 2 | 0 | P:6 | 5.9 | 6.3 | 1.07 | 593 | 0.74 | 0.96 | 0.7 | Comparative Example |
| 12 | L | 870 | 60 | 25 | 100 | GI | 95 | 2 | 0 | P:3 | 5.5 | 7.8 | 1.42 | 599 | 0.72 | 0.96 | 0.8 | Comparative Example |
| 13 | M | 870 | 60 | 25 | 100 | GI | 79 | 21 | 0 | 0 | 5.8 | 3.0 | 0.52 | 832 | 0.65 | 0.97 | 0 | Comparative Example |
| 14 | N | 870 | 60 | 25 | 100 | GA | 92 | 8 | 0 | 0 | 13.0 | 5.3 | 0.41 | 592 | 0.62 | 0.96 | 1.9 | Comparative Example |
| 15 | O | 870 | 60 | 25 | 100 | GI | 88 | 12 | 60 | 0 | ※ | 3.0 | — | 746 | 0.79 | 0.88 | 0 | Comparative Example |
| 16 | P | 860 | 60 | 25 | 100 | GI | 90 | 10 | 0 | 0 | 5.3 | 3.0 | 0.57 | 642 | 0.73 | 0.96 | 0 | Comparative Example |
| 17 | A | 855 | 100 | 25 | 100 | GA | 90 | 10 | 2 | 0 | 4.7 | 3.2 | 0.68 | 665 | 0.69 | 0.96 | 0 | Example |
| 18 | A | 900 | 45 | 25 | 100 | CR | 90 | 10 | 0 | 0 | 6.4 | 2.7 | 0.42 | 605 | 0.74 | 0.96 | 0 | Example |
| 19 | A | 880 | 60 | 10 | 100 | CR | 93 | 7 | 0 | 0 | 5.3 | 3.3 | 0.62 | 594 | 0.76 | 0.96 | 0 | Example |
| 20 | A | 870 | 80 | 25 | 50 | CR | 88 | 12 | 0 | 0 | 4.9 | 3.1 | 0.63 | 645 | 0.72 | 0.96 | 0 | Example |
| 21 | A | 880 | 60 | 25 | 240 | GA | 93 | 7 | 0 | 0 | 5.6 | 3.0 | 0.54 | 612 | 0.75 | 0.96 | 0 | Example |
| 22 | F | 950 | 60 | 25 | 100 | GI | 87 | 13 | 0 | 0 | 21.1 | 10.3 | 0.49 | 592 | 0.64 | 0.96 | 0 | Comparative Example |
| 23 | G | 800 | 60 | 25 | 100 | GA | 93 | 7 | 35 | 0 | ※ | 3.0 | — | 815 | 0.88 | 0.85 | 0 | Comparative Example |
| 24 | G | 850 | 10 | 25 | 100 | GA | 93 | 7 | 20 | 0 | 4.3 | 2.7 | 0.62 | 752 | 0.71 | 0.89 | 0 | Comparative Example |
| 25 | F | 870 | 200 | 25 | 100 | GA | 91 | 9 | 0 | 0 | 11.2 | 7.0 | 0.63 | 615 | 0.63 | 0.96 | 0 | Comparative Example |
| 26 | A | 870 | 60 | 3 | 100 | GA | 91 | 1 | 0 | P:8 | 4.9 | 2.7 | 0.55 | 599 | 0.75 | 0.96 | 1.2 | Comparative Example |
| 27 | C | 870 | 60 | 25 | 10 | GI | 81 | 19 | 0 | B:7 | 6.3 | 3.1 | 0.49 | 817 | 0.66 | 0.97 | 0 | Comparative Example |
| 28 | C | 870 | 60 | 30 | 15*2 | GA | 89 | 4 | 0 | B:7 | 5.7 | 0.2 | 0.04 | 634 | 0.76 | 0.96 | 0.9 | Comparative Example |
| 29 | B | 870 | 60 | 25 | 480 | GA | 90 | 1 | 0 | P:9 | 4.9 | 2.9 | 0.59 | 612 | 0.77 | 0.96 | 1.1 | Comparative Example |

*1L is an average value of intervals between martensite grains closest to each other.

*2total of retention time in primary cooling and holding time in alloying treatment.

*3P is pearlite and B is bainite.

※Measurement is impossible due to the residence of unrecrystallized structure.

The above measured results are also shown in Table 2, from which the following are revealed.

All the steel sheets No. 1-10 and 17-21 satisfy the targeted requirements for chemical compositions of steel and production conditions (continuous annealing conditions) and thus have targeted properties of tensile strength, yield ratio and aging resistance.

On the contrary, the steel sheets No. 11-15 have chemical compositions of steel outside our range so that the desired steel structure is not obtained and the targeted high strength cannot be obtained.

Also, the steel sheet No. 16 satisfies the mechanical properties, but is poor in the surface quality because Si content is 0.60 mass %, which is higher than our range.

The steel sheets No. 22-25 have soaking annealing conditions in the continuous annealing outside our range and thus have steel structures also outside our range, causing that the targeted high strength cannot be obtained.

The steel sheet No. 26 has a primary cooling rate in the continuous annealing slower than that our range, and thus cannot obtain the desired martensite fraction and is poor in the aging resistance.

The steel sheet No. 27 is cooled to 600-500° C. by the primary cooling in the continuous annealing and then retained within the temperature range for a retention time shorter than our range so that the transformation of austenite into martensite is insufficient in the steel sheet, and the martensite fraction becomes too large and causes the yield ratio to be decreased and the targeted range thereof cannot be obtained.

The steel sheet No. 28 is an example in which the retention time at 600-500° C. is 10 seconds because the steel sheet is cooled to 600° C. at 15° C./s by the primary cooling after the soaking annealing, subsequently cooled to lower than 500° C., retained in a temperature range of lower than 500° C. for 60 seconds and then subjected to an alloying hot-dip galvanizing treatment. Since the retention time at 600-500° C. after the primary cooling is short, the transformation of austenite into ferrite is insufficient while the transformation into bainite is too promoted so that austenite is non-uniformly divided by bainite and the given interval between martensite grains closest to each other cannot be obtained, and therefore, the excellent aging resistance is not attained.

The steel sheet No. 29 has a retention time at 600-500° C. in the continuous annealing longer than that of our range so that the transformation of austenite into ferrite is excessively promoted to decrease the martensite fraction to be smaller than that of our range, and the excellent aging resistance cannot be attained.

INDUSTRIAL APPLICABILITY

The cold rolled steel sheets are suitable as a raw material of a high-strength part such as framework parts, crash-resistant parts and so on of automotive bodies and can be preferably used as a raw material for applications requiring high strength, high yield ratio, excellent aging resistance and anisotropy of tensile strength.

The invention claimed is:

1. A cold rolled steel sheet having a chemical composition consisting of C: 0.06-0.14 mass %, Si: less than 0.50 mass %, Mn: 1.6-2.5 mass %, P: not more than 0.10 mass %, S: not more than 0.020 mass %, Al: 0.01-0.10 mass %, N: not more than 0.010 mass %, Nb: not more than 0.080 mass %, Ti: not more than 0.080 mass%, provided that Nb and Ti are contained in an amount of 0.020-0.080 mass % in total, one or more selected from Mo: not more than 0.3 mass %, B: not more than 0.005 mass %, Cu: not more than 0.3 mass %, Ni: not more than 0.3 mass % and Sb: not more than 0.3 mass %, and the remainder being Fe and inevitable impurities, a steel structure that an area ratio of ferrite is not less than 85%; an area ratio of martensite is 3-15%; an area ratio of unrecrystallized ferrite is not more than 5%; an average crystal grain size d of the ferrite is 2-8 μm; and a ratio (L/d) of an average value L (μm) among intervals between martensite grains closest to each other to the average crystal grain size d of the ferrite is 0.20-0.80, and mechanical properties wherein a yield ratio YR in a direction perpendicular to a rolling direction is not less than 0.68 and a ratio ($TS_D/TS_C$) of tensile strength $TS_D$ in a direction of 45° to the rolling direction to tensile strength $TS_C$ in a direction perpendicular to the rolling direction is not less than 0.95.

2. The cold rolled steel sheet according to claim 1, wherein a zinc-based plated layer is arranged on a surface of the steel sheet.

3. The cold rolled steel sheet according to claim 2, wherein the zinc-based plated layer is a hot-dip galvanized layer.

4. The cold rolled steel sheet according to claim 2, wherein the zinc-based plated layer is an alloyed hot-dip galvanized layer.

5. The cold rolled steel sheet according to claim 2, wherein the zinc-based plated layer is an electrogalvanized layer.

6. A method of manufacturing the cold rolled steel sheet comprising hot rolling and cold rolling a steel material having the chemical composition of claim 1 and subjecting an obtained cold rolled sheet to a continuous annealing, comprising steps of:

soaking-annealing at a temperature of 840-940° C. for a holding time of 30-120 seconds, cooling from the soaking-annealing temperature to 600° C. at a rate of not less than 5° C./s, retaining at a temperature of 600-500° C. for 30-300 seconds, and then conducting a secondary cooling.

7. The method according to claim 6, wherein a surface of the steel sheet is subjected to a hot-dip galvanizing after retention at a temperature of 600-500° C. and before the secondary cooling.

8. The method according to claim 6, wherein a surface of the steel sheet is subjected to an alloying hot-dip galvanizing after retention at a temperature of 600-500° C. and before the secondary cooling.

9. The method according to claim 6, wherein a surface of the steel sheet is subjected to an electrogalvanizing after the secondary cooling.

* * * * *